United States Patent [19]

Benham

[11] Patent Number: 4,750,745

[45] Date of Patent: Jun. 14, 1988

[54] AERIAL PROJECTIBLE TOY

[76] Inventor: Junior H. Benham, 10045 NE. 17th St., Bellevue, Wash. 98004

[21] Appl. No.: 886,400

[22] Filed: Jul. 17, 1986

[51] Int. Cl.[4] ..... A63B 67/00

[52] U.S. Cl. ..... 273/327; 273/428; 446/188; 446/485

[58] Field of Search ..... 273/327, 428; 135/77; 446/188, 485

[56] References Cited

U.S. PATENT DOCUMENTS

| | | | |
|---|---|---|---|
| 1,385,642 | 7/1921 | Restein | 273/428 X |
| 2,904,931 | 9/1959 | Hanf | 446/188 |
| 3,069,804 | 12/1962 | Cirafesi | 273/428 X |
| 3,528,659 | 9/1970 | Benham | 273/327 |
| 3,659,849 | 5/1972 | Seymour | 273/327 |
| 3,935,669 | 2/1976 | Potrzuski | 446/485 |
| 4,380,134 | 4/1983 | Taluba et al. | 446/188 |

*Primary Examiner*—William H. Grieb
*Attorney, Agent, or Firm*—Harry M. Cross, Jr.

[57] ABSTRACT

A baton and control wand for the baton are described. The baton comprises a shaft mounting a cup at each end. The central wand, by engaging the cup, controls and directs the baton during play. The cups may contain apertures for attachment of end accessories such as a Cyalume light or a highly resilient ball. The baton shaft may be fluted or may be provided with a pitch pipe whistle, which generate sounds during play.

12 Claims, 3 Drawing Sheets

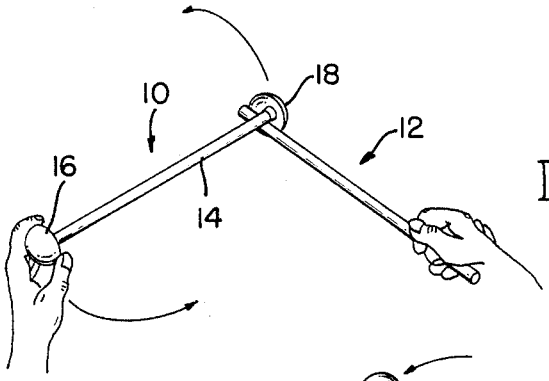
FIG. 1
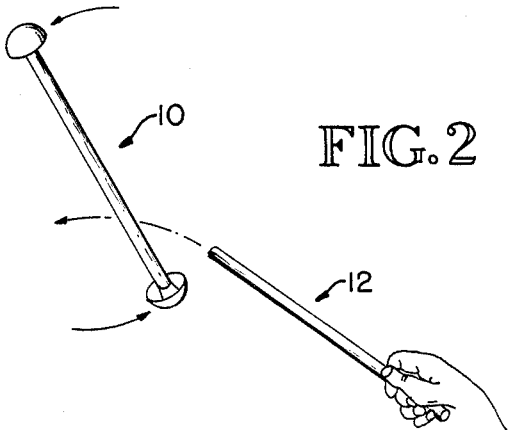
FIG. 2
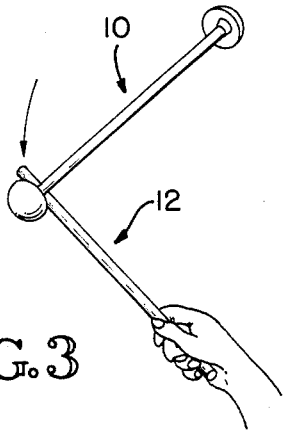
FIG. 3
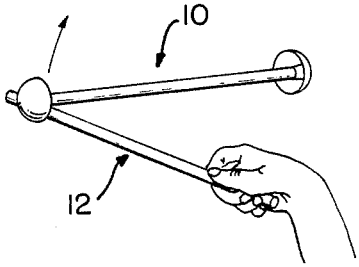
FIG. 4
FIG. 5
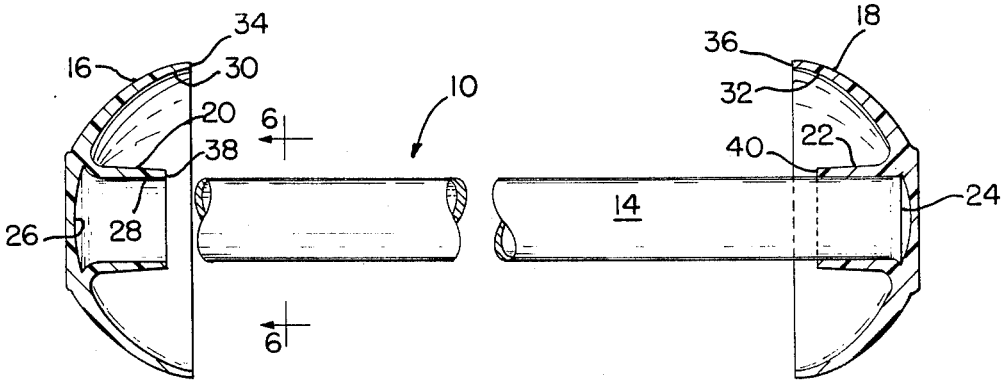

FIG. 6
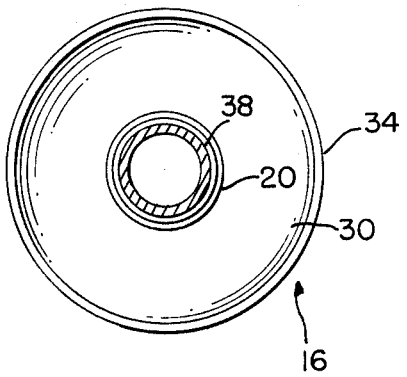
FIG. 8
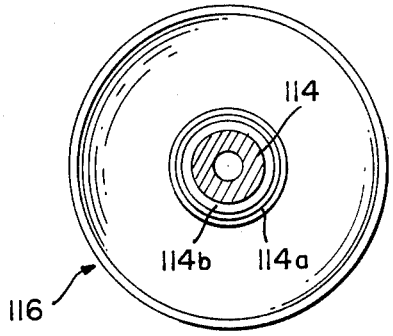
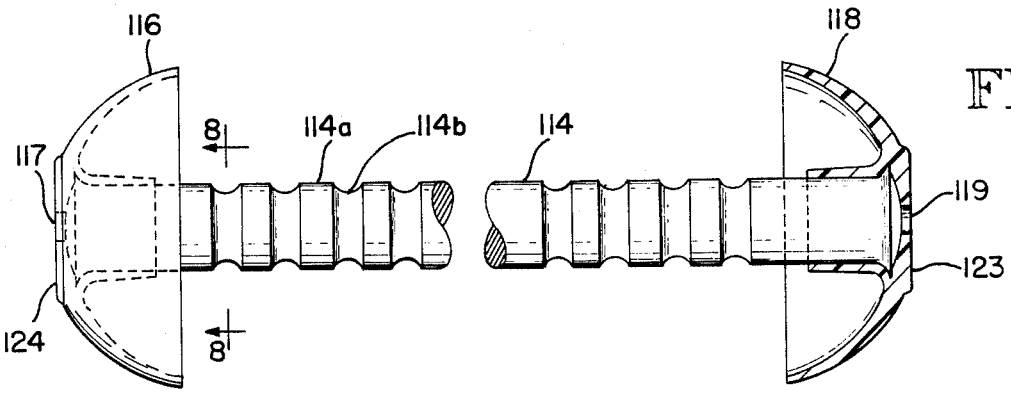
FIG. 7
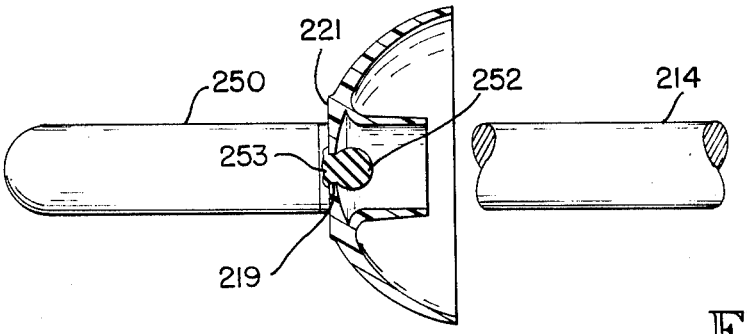
FIG. 9

AERIAL PROJECTIBLE TOY

FIELD OF THE INVENTION

This invention relates to toys and particularly to toys of the type that are twirled and projected through the air.

BACKGROUND OF THE INVENTION

The present invention is an improvement on my aerial projectile toy described in U.S. Pat. No. 3,528,659. An object of the present invention is to improve on the design and functionability of my aerial projectile toy, to enable it to be packaged and shipped in a compact manner, and to make it more adaptable for accommodating a variety of accessories.

SUMMARY OF THE INVENTION

My improved aerial projectile toy comprises a baton and a wand for imparting motion to the baton. The baton itself comprises a shaft capped at each end by one of a pair of cups. The cups are secured to the shaft and face one another. The shaft ends are flared and designed to fit within an integral base formed within the concave interior of each cup. Each cup base is formed to provide an interior cylindrical passage, or socket, the inner end of which is flared outward to receive one of the flared ends of the shaft. The cups are fabricated from a flexible material of a rubber or plastic nature and are so formed that the shaft ends may be forced into the cup sockets with the flared ends fitted into flared bottom sockets to secure the cup on the shaft. Likewise, the cups may be pulled from the shafts so that the baton can be stored or shipped in a compact, knock-down, configuration.

To facilitate, the addition of accessories to the baton, the cup bases are made thicker and therefore less flexible, and are provided with a small circular aperture, located axially of the cup and communicating with the interior of the adjacent socket. The shaft may be cylindrical. The shaft may also be provided with a series of alternating annular ribs and concave grooves along its exposed length.

DETAILED DESCRIPTION OF THE DRAWINGS

FIGS. 1–4 illustrate the operation of my aerial projectile toy and one manner of interaction between the baton and the wand;

FIG. 5 is a side elevation of the baton with one cup shown in cross-section;

FIG. 6 is a cross-section taken along the line 6—6 of FIG. 5;

FIG. 7 is a side elevation of another embodiment of the baton, with a fluted shaft, one cup is shown in cross-section;

FIG. 8 is a cross-section taken along the line 8—8 of FIG. 7;

FIGS. 9 and 10 are partial side elevations of the baton illustrating the attachment of accessories to one of the cups.

DETAILED DESCRIPTION

Figure 10:
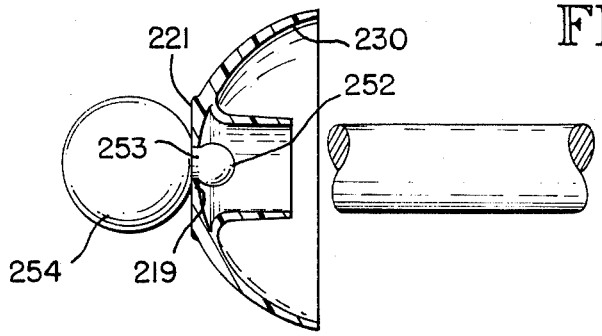

The improved aerial projection toy of the present invention comprises a baton 10 designed to be manipulated by a hand-held wand or rod 12. The baton comprises a shaft 14 having inwardly facing cups 16 and 18 secured to the shaft, one at each end. The cups 16, 18 are designed to be engaged by the rod 12 so that the baton can be twirled, flipped, tossed or thrown by the rod. As illustrated in FIGS. 1–4, the baton 10 can be spun around the rod 12 with the cup on the right side of the player being engaged with rod 12 with the aid of centrifugal force. The baton can be tossed, or flipped and, while loose in the air, the rod can be moved to contact the baton and engage the cup on the left side of the player to reverse the spinning direction of the baton.

As shown in FIG. 5, the baton 10 comprises the shaft 14 and end cups 16 and 18. The shaft has end portions adapted to be inserted into sockets provided by bases 20, 22 formed within the cups 16, 18. These shaft end portions are provided with flared ends, as at 24. The socket bottoms are also flared, as at 26, to receive the shaft flared ends. The cups are formed from a suitably resilient or flexible material such that a shaft flared end can be forced through the main cylindrical passage of the socket, as at 28, in the bases and seated in the flared socket bottom. The bottom of the socket is not only flared but is concaved as well so that the main portion of the socket bottom surface stands away from the shaft end as shown with respect to cup 18 in FIG. 5.

The curved outer wall of 30, 32 of each cup ends in a circular rim 34, 36 that stands further inward around the shaft 14 than the base 20, 22. The relative locations of the rims 34, 36 and the ends 38, 40 of the bases is important to the functioning of the toy. During use, the rod 12 will be slid back and forth along the shaft 14 at one time or another in the process of engaging first one cup and then the other cup. The rod typically engages a cup rim 34, 36 first and, as the cup side wall flexes outward as a result of centrifugal force, the rod may also engage the inner curved surface of the cup. By locating the cup rim 34, 36 inwardly of the outer end 38, 40 of the base, the rod will not hit the base. Were the rod to initially contact the base, the baton might well ricochet off the rod and out of play.

The embodiment shown in FIG. 6 has a shaft 114 provided with a fluted outer surface. The outer surface is comprised of an alternating series of annular ribs **114*a* and concave rings 114*b***. The shaft end portions are not fluted, of course. This configuration makes the shaft a resonator bar. When the control rod glides across the shaft during play, the ribbed shaft surface produces a monographic rallentando sound. This rhythmic vibration also causes minute centripetal forces that aid in the baton clinging to the control rod while the baton is in a pendulum motion.

The FIG. 7 embodiment has cups 116 and 118 provided with axial apertures 117, 119 provided in the base portions 121, 123 of the cups. These apertures are coaxial with the base sockets and open to the socket interiors. The base portions of the cup are thickened so as to provide some structural rigidity to the material in which the apertures 117, 119 are provided. These apertures enable the attachment of various accessories such as a cylume light, FIG. 9, manufactured by Cyanamide or a Zextron ball, FIG. 10. They also enable the provision of a shaft-contained musical whistle, FIG. 11.

In the FIGS. 9 and 10 embodiments, the shaft 214 is hollowed-out, or tubular at least in the end portion, to accommodate a ball end attachment 252 of an accessory such as a Cylume light 250, FIG. 9, or a Zextron ball 254, FIG. 10. The ball attachment 252 in both instances has a diameter slightly larger than aperture 219 and is connected through a neck 253 to the respective accessory. The neck 253 has nearly the same diameter as aperture 219. Although structurally stiffer than the cup side wall 230, the base portion 221 is sufficiently flexible that the ball attachment 252 can be forced through aperture 219 and held in place when the apparatus resumes its normal diameter.

Figure 11:
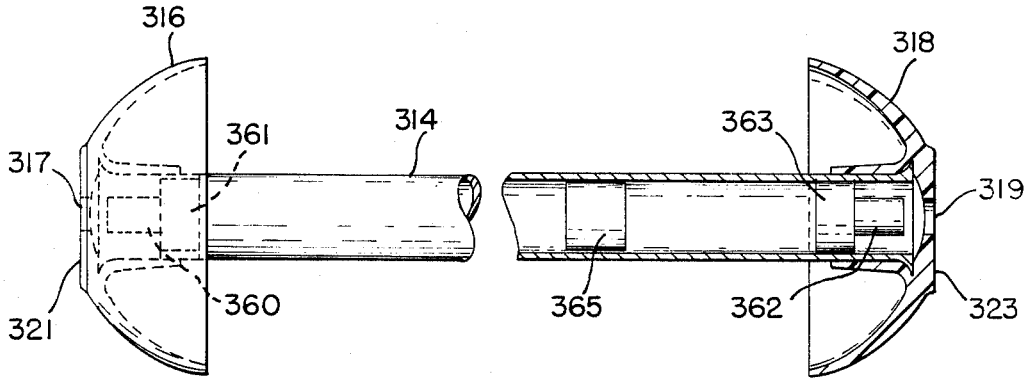
FIG. 11 is a side elevation, partially in cross-section, of still another embodiment of the baton.

The Zextron ball of FIG. 11 is made of a very high resiliency material. During play, the baton can be thrown to the ground surface on its ball end. The Zextron ball will cause the baton to rebound radically, offered an extended challenge to the player. A baton thus equipped can be bounced off a wall as well as a floor.

The FIG. 11 embodiment of the baton comprises a hollow shaft 314 provided with a pitch pipe whistle 360, 362 inserted into each shaft end portion and secured therein by an annular seal ring 361, 363. The pitch pipe whistle is mounted in the seal ring and the seal ring is slipped into the shaft end portion and bonded to the shaft inner wall surface. The shaft also contains a compressor 365 that loosely fits within the shaft interior. During assembly, the compressor is inserted first, followed by installation of the pitch pipe whistles. The compressor may be formed of any material that has sufficient weight to slide freely from one end to the other when the baton is in motion and subjected to centrifugal force. During play, as the baton is twirled the compressor will slide from one end to the other, compressing the air ahead of it. The compressed air then flows though the pitch pipe 360, 362, causing it to operate, and out through the adjacent aperture 317, 319 in the base portion 321, 333 of cup 316, 318.

Although the invention has been described with reference to specific embodiments, it will be understood that modifications may be made and that the various embodiments may be combined without departing from the scope of the invention.

What is claimed:

1. An aerial projectible toy comprising a baton and wand means for controlling the baton, said baton comprising a shaft and a pair of flexible cups each mounted on an end portion of said shaft; each of said shaft end portions being provided with a flared end and each of said cups being provided with sockets having flared bottoms for receiving and securing a flared shaft end, said shaft end portions and cup sockets being so constructed and arranged as to permit assembly and disassembly of said shaft and cups; said shaft also being provided, in its portion extending between said cups, with a fluted outer surface comprising a series of alternating annular ribs and concave grooves along its exposed length whereby the ribbed shaft surface can interact with said wand during play to aid in the baton clinging to said wand when the baton is in a pendulum motion.

2. The toy of claim 1 wherein at least one of said cups is provided with a base portion having an aperture therethrough communicating with the interior of said cup socket.

3. The toy of claim 2 including an accessory mountable to said baton and comprising an attachment member insertable through said aperture to detachably secure said accessory to said cup-containing aperture.

4. The toy of claim 3 wherein said accessory is a self-illuminating light provided with a ball attachment insertable through said aperture.

5. The toy of claim 3 wherein said accessory is a ball made of highly resilient material and provided with a ball attachment insertable through said aperture.

6. The toy of claim 2 wherein said shaft is tubular and comprising at least one pitch pipe whistle mounted in a shaft end portion, and a compressor carried in said shaft to actuate said whistle, said whistle being in communication with said aperture for passage of air into and out of said whistle.

7. An aerial projectible toy comprising a baton and wand means for controlling the baton, said baton comprising a shaft and a pair of flexible cups each mounted on an end portion of said shaft, at least one of said cups being provided with a base portion having an aperture therethrough; said shaft being provided, in its portion extending between said cups, with a fluted outer surface comprising a series of alternating annular ribs and concave grooves along its exposed length whereby the ribbed shaft surface can interact with said wand during play to aid in the baton clinging to said wand when the baton is in a pendulum motion.

8. The toy of claim 7 including an accessory mountable to said baton and comprising an attachment member insertable through said aperture to detachably secure said accessory to said cup-containing aperture.

9. The toy of claim 8 wherein said accessory is a self-illuminating light provided with a ball attachment insertable through said aperture.

10. The toy of claim 8 wherein said accessory is a ball made of highly resilient material and provided with a ball attachment insertable through said aperture.

11. The toy of claim 7 wherein said shaft is tubular and comprising at least one pitch pipe whistle mounted in a shaft end portion, and a compressor carried in said shaft to actuate said whistle, said whistle being in communication with said aperture for passage of air into and out of said whistle.

12. The toy of claim 7 wherein said shaft is provided with a fluted outer surface between said shaft end portions.

* * * * *